US005571984A

United States Patent [19]

Ferrand

[11] Patent Number: 5,571,984

[45] Date of Patent: Nov. 5, 1996

[54] AMMUNITION FEED SYSTEM FOR A MEDIUM-CALIBRE FIREARM

[75] Inventor: Guy Ferrand, Bourges, France

[73] Assignee: Giat Industries, Versailles, France

[21] Appl. No.: 375,103

[22] Filed: Jan. 19, 1995

[30] Foreign Application Priority Data

Jan. 21, 1994 [FR] France ..... 94 00625

[51] Int. Cl.[6] ..... F41A 9/03; F41A 9/04

[52] U.S. Cl. ..... 89/33.16; 89/33.17; 89/33.02

[58] Field of Search ..... 89/33.17, 33.02, 89/33.1, 33.03, 33.14, 33.16

[56] References Cited

U.S. PATENT DOCUMENTS

| | | | |
|---|---|---|---|
| 2,910,917 | 11/1959 | Herlach et al. | 89/33.1 |
| 4,004,490 | 1/1977 | Dix et al. | 89/34 |
| 4,742,756 | 5/1988 | Mannhart | 89/33.02 |
| 4,841,837 | 6/1989 | Novet | 89/35.01 |
| 5,175,388 | 12/1992 | Maher et al. | 89/33.16 |

FOREIGN PATENT DOCUMENTS

| | | | |
|---|---|---|---|
| 0 152 549 | 8/1985 | European Pat. Off. . | |
| 0 231 493 | 8/1987 | European Pat. Off. . | |
| 0 233 347 | 8/1987 | European Pat. Off. . | |
| 0 338 301 | 10/1989 | European Pat. Off. . | |
| 0 365 145 | 4/1990 | European Pat. Off. . | |
| 933264 | 4/1948 | France | 89/33.17 |
| 2 637 061 | 3/1990 | France . | |
| 624355 | 6/1949 | United Kingdom | 89/33.17 |

OTHER PUBLICATIONS

English translation of French patent #933,264.

*Primary Examiner*—Stephen M. Johnson
*Attorney, Agent, or Firm*—Lowe, Price, LeBlanc & Becker

[57] ABSTRACT

Medium-calibre feed system, of the type comprising an ammunition feed system and a firing and loading system with a barrel, for example, which is characterized in that it comprises an ammunition box in which the ammunition is stored without being linked together by any medium, a drive mechanism for loading the ammunition, round by round, to the loading and firing system, an energy source for controlling the drive mechanism during the firing of a burst, the latter comprising a link of the elastic type interposed between the ammunition box and the firing and loading system, this link consisting, for example, of a chain conveyor.

25 Claims, 6 Drawing Sheets

AMMUNITION FEED SYSTEM FOR A MEDIUM-CALIBRE FIREARM

FIELD OF THE INVENTION

The present invention relates to an ammunition feed system for a medium-calibre firearm, of the type comprising a box in which the ammunition is stored without being linked together by any medium, such as links for example, and a drive mechanism for extracting the ammunition from the box and leading it to a weapon loading and firing system.

BACKGROUND OF THE INVENTION

A weapon must be capable of almost instantaneously firing short bursts against targets which may be particularly fleeting. In order to achieve a high firing rate, which is necessary to hit such a target, use is made either of a multi-tube weapon of the GATLING type, which, however, exhibits the notable drawback of being heavy and bulky, or a weapon with one or two tubes, of the type with a barrel, which is lighter and more compact, but which is of lower performance in terms of the rate of fire than a weapon of the GATLING type.

In an automatic weapon of the barrel type, as described in the document FR-A-2637061 for example, the ammunition feed system consists of a belt composed of a succession of links which each support one round. This belt, stored in an ammunition box, is partially wound over a feed star wheel which interacts with a pick-off device to extract the ammunition from the links of the belt. The ammunition, free from its links, is then led by an insertion star wheel to the chambers of the barrel into which it is progressively inserted in the course of the intermittent rotation of the barrel. The energy source for transferring the ammunition from the belt to the barrel generally consists of a part of the propulsion gases generated by the round fired and which are used to drive the barrel in rotation, this rotational movement being simultaneously transmitted by the insertion star wheel to the feed star wheel by pinions. The empty links of the belt are generally recovered into the ammunition box. Such a recovery of the links constitutes a drawback, especially when the weapon is installed on an aircraft.

One object of the invention is particularly to resolve the problem posed by the ejection of the links of the ammunition belt, by virtue of a feed system of completely different design in which the ammunition rounds are stored in an ammunition box without being linked to one another by any intermediate medium, that is to say that the abovementioned links are purely and simply dispensed with.

An ammunition box or magazine without links is described, for example, in the document EP-A-0 365 145. The ammunition is arranged at the periphery of a rotary unit mounted in a box and interacting with a helical fixed ramp on the inner wall of the box in order to move it axially during rotation of the rotary unit.

However, a feed system which necessarily comprises a drive mechanism for leading the ammunition rounds, one by one, to a weapon loading and firing system poses other problems which are related particularly, on the one hand, to the obtaining of an instantaneous rise in rate of the weapon, having regard to the inertia inherent in the ammunition drive mechanism, and, on the other hand, to the recoil movement of the weapon which must not disturb said ammunition drive mechanism.

These problems which are posed particularly for a medium-calibre weapon are not set out in the document EP-A-0 365 145 which relates to a small-calibre weapon, of the machine pistol type.

OBJECTS AND SUMMARY OF THE INVENTION

Thus, the main object of the invention is to resolve all of these problems, and to this end the invention proposes an ammunition feed system, of the abovementioned type, for a medium-calibre firearm, which is characterized in that the drive mechanism comprises a link of the elastic type interposed between the ammunition box and the weapon loading and firing system, this link consisting of a chain conveyor, for example.

According to another characteristic of the invention, the chain of the conveyor is wound over two drive wheels respectively situated on the ammunition box side and the weapon side, said wheels being driven respectively in rotation by a motor member of the drive mechanism and by a motor member of the weapon.

According to one embodiment, the chain consists of a succession of elastically deformable links, linked in pairs in an articulated way by spacer spindles and by cradles supported by the spacer spindles and intended to accommodate the ammunition, each cradle being mounted articulated on two consecutive spacer spindles and including two elastic lateral edges between which an ammunition round is retained.

In a general way, the drive wheels of the conveyor each consist of a shaft and of two pinions integral with said shaft and intended to come into engagement with the chain of the conveyor.

According to one embodiment example, each tooth of the pinions of the drive wheel, on the ammunition box side, includes a notch intended to accommodate a spacer spindle in order to provide the drive for the chain, and each tooth of the pinions of the drive wheel, on the weapon side, is formed by a lobe, two consecutive lobes delimiting a groove intended to accommodate a spacer spindle in order to provide the drive for the chain.

Moreover, the drive wheels of the conveyor are each partially surrounded by a casing comprising guide slots for rollers supported at each of the ends of the spacer spindles, and the lobes of the drive wheel, on the weapon side, have the function of partially extracting the ammunition from the cradles of the chain in the course of their transfer to the weapon loading and firing system.

According to another characteristic of the invention, the ammunition box consists of a fixed hollow body which delimits an internal housing of cylindrical shape extending along an axis parallel to the firing direction of the weapon, and of a hollow and cylindrical support unit mounted so as to rotate within the abovementioned housing, the support unit including, at its periphery, a plurality of ammunition-accommodating chutes, parallel to the abovementioned axis and regularly distributed around said unit.

In a general way, the distance separating the bottom of a chute and the inner wall of the housing of the body of the ammunition box is slightly greater than the diameter of a round.

According to another characteristic of the invention, the drive mechanism also comprises a fixed, variable-pitch, helical ramp provided on the wall of the inner housing of the body of the ammunition box, a shaft for rotational control of the ammunition support unit, and a main energy source for driving the said control shaft in rotation.

According to one embodiment example, the control shaft is housed within the ammunition support unit and physically represents the abovementioned axis, a pinion integral with said shaft engaging with a toothed wheel provided on the inner wall of the hollow ammunition support unit, the shaft of the drive wheel of the conveyor on the ammunition box side being integral with and in the extension of the shaft for rotational control of the ammunition support unit.

According to another characteristic of the invention, the drive mechanism also comprises an auxiliary energy source for controlling the rotation of the ammunition support unit and the drive wheel of the conveyor, on the ammunition box side, in order to obtain an instantaneous rise in the rate of the weapon at the start of the firing of a burst.

According to another characteristic of the invention, the abovementioned auxiliary energy source consists of an elastically deformable means capable of storing energy and of yielding it up instantaneously at the start of the firing of a burst, this auxiliary energy source advantageously consisting, for example, of the shaft for rotational control of the ammunition support unit and of the drive wheel of the conveyor, on the ammunition box side, this shaft being a torsion shaft.

According to another characteristic of the invention, the torsion shaft is loaded to a torque value determined by the main energy source, such as a motor/reducing gear, which is associated with a free wheel in order to keep the torsion shaft in the loaded state, the drive mechanism also comprising a braking device for immobilizing the ammunition support unit before the start of a burst on the one hand, and after the end of a burst on the other hand.

In a general way, the chain of the conveyor, is separated into an outward upper strand and a return lower strand, and, according to another characteristic of the invention, the drive mechanism also comprises two upper and lower tension members associated respectively with the upper and lower strands of the chain in order to damp the oscillations of the latter.

According to an example of an embodiment of the invention, the upper and lower tension members each consist of an arm pivoting in a plane parallel to that of the chain, a shoe mounted articulated at one end of the pivoting arm in order to bear on the associated strand of chain, and a torsion bar fixed to the other end of said arm, in order to stress the shoe bearing on the associated strand of chain.

According to another characteristic of the invention, the lower tension member of the chain controls the braking device of the ammunition support unit.

According to yet another characteristic of the invention, the braking device consists of two shoes supported by pivoting jaws and intended to come into contact with the inner wall of the ammunition support unit, said jaws being controlled simultaneously by a cam which is itself controlled in rotation by the lower tension member of the chain.

According to yet another characteristic of the invention, the casing which partially surrounds the drive wheel of the conveyor, on the ammunition box side, is integral with the body of said box, whereas the casing which surrounds the drive wheel of the conveyor, on the weapon side, is integral with the weapon, the two casings being linked together by a deformable parallelogram in order not to disturb the drive mechanism during the recoil movement of the weapon consequent on the firing of a round.

Advantageously, the body of the ammunition box is integrated into a container which also supports the weapon, this container being intended to be installed on an aircraft for example.

By way of example, the weapon loading and firing system may be a barrel-type system with a feed star wheel which interacts with the drive wheel of the conveyor, on the weapon side, an insertion star wheel which interacts with the feed star wheel in order progressively to load the ammunition into the chambers of the barrel, the abovementioned star wheels being driven in rotation by the barrel which is itself driven by a motor member or by borrowing gas from a fired round.

Advantageously, a medium-calibre weapon according to the invention may be installed on an aircraft, and may be capable of firing a burst at a high rate of fire capable of reaching 2500 rounds per minute for example, a rate which is obtained as from the start of the burst by virtue of the action of the auxiliary energy source which instantaneously actuates the ammunition drive mechanism.

BRIEF DESCRIPTION OF THE DRAWINGS

Other advantages, characteristics and details of the invention will emerge from the explanatory description which will follow, which is given by reference to the attached drawings, which are given only by way of example and in which.

MORE DETAILED DESCRIPTION

The ammunition feed system 1 illustrated in the various figures is intended particularly to feed a medium-calibre firearm. This system 1 generally comprises a box 3 containing ammunition M, and a mechanism 5 for driving this ammunition to a weapon loading and firing system 7 (FIG. 1).

Figures 1, 2, 3:
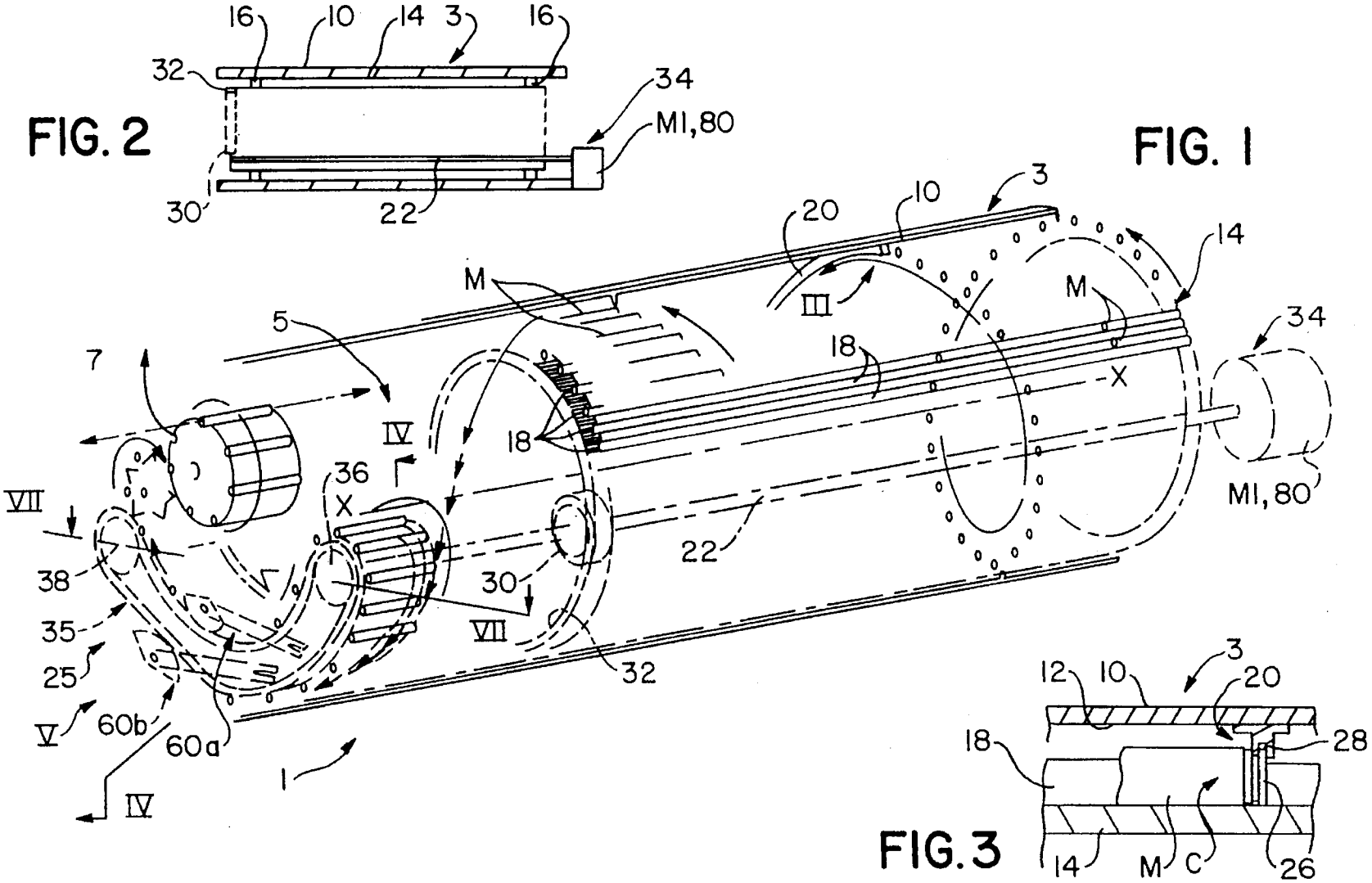
FIG. 1 is a simplified view in perspective of a medium-calibre weapon feed system according to the invention.
FIG. 2 is a diagrammatic view of the ammunition box of the weapon feed system of FIG. 1.
FIG. 3 is in enlarged view of the detail indicated by the arrow III of FIG. 1.

As illustrated in FIGS. 1 to 3, the ammunition box 3 consists of a fixed, hollow and elongate body 10, which delimits an internal housing 12 of cylindrical shape extending along an axis X—X parallel to the direction of fire of the weapon. A hollow and cylindrical support unit 14 is mounted so as to rotate within the housing 12 around the axis X—X by means of roller bearing 16 (FIG. 2). The support unit 14 includes, at its periphery, a plurality of longitudinal chutes 18, parallel to the axis X—X and regularly distributed around the unit 14.

The ammunition rounds M are stored loosely one behind the other, in each of the chutes 18 and without being linked together by links. The distance separating the bottom of a chute 18 and the wall of the internal housing 12 is slightly greater than the diameter of an ammunition round M.

The drive mechanism 5 for leading the ammunition M from the ammunition box 3 to the loading and firing system 7 comprises a fixed helical ramp 20, a shaft 22 for rotational control of the ammunition M support unit 14 and a conveyor 25 interposed between the ammunition box 3 and the weapon loading and firing system 7.

The fixed helical ramp 20 is provided on the wall of the internal housing 12 of the box 3. Each ammunition round M bears via its base cap C against the helical ramp 20, the pitch of which is greater than the length of an ammunition round M. By way of example, referring to FIG. 3, the end of the base cap C of each munition round M includes an external radial rim 26 which engages freely in a helical slot 28 formed along the ramp 20.

The shaft 22 for rotational control of the ammunition M support unit 14 extends parallel to the axis X—X and passes through the support unit 14 from end to end. A pinion 30 integral with the shaft 22 engages with a toothed crown wheel 32 provided on the inner wall of the support unit 14. Rotation of the shaft 22 is provided from a main energy source 34 consisting of a motor member Ml, such as a motor/reducing gear, the output shaft of which is coupled to one end of the shaft 22.

Figure 4:
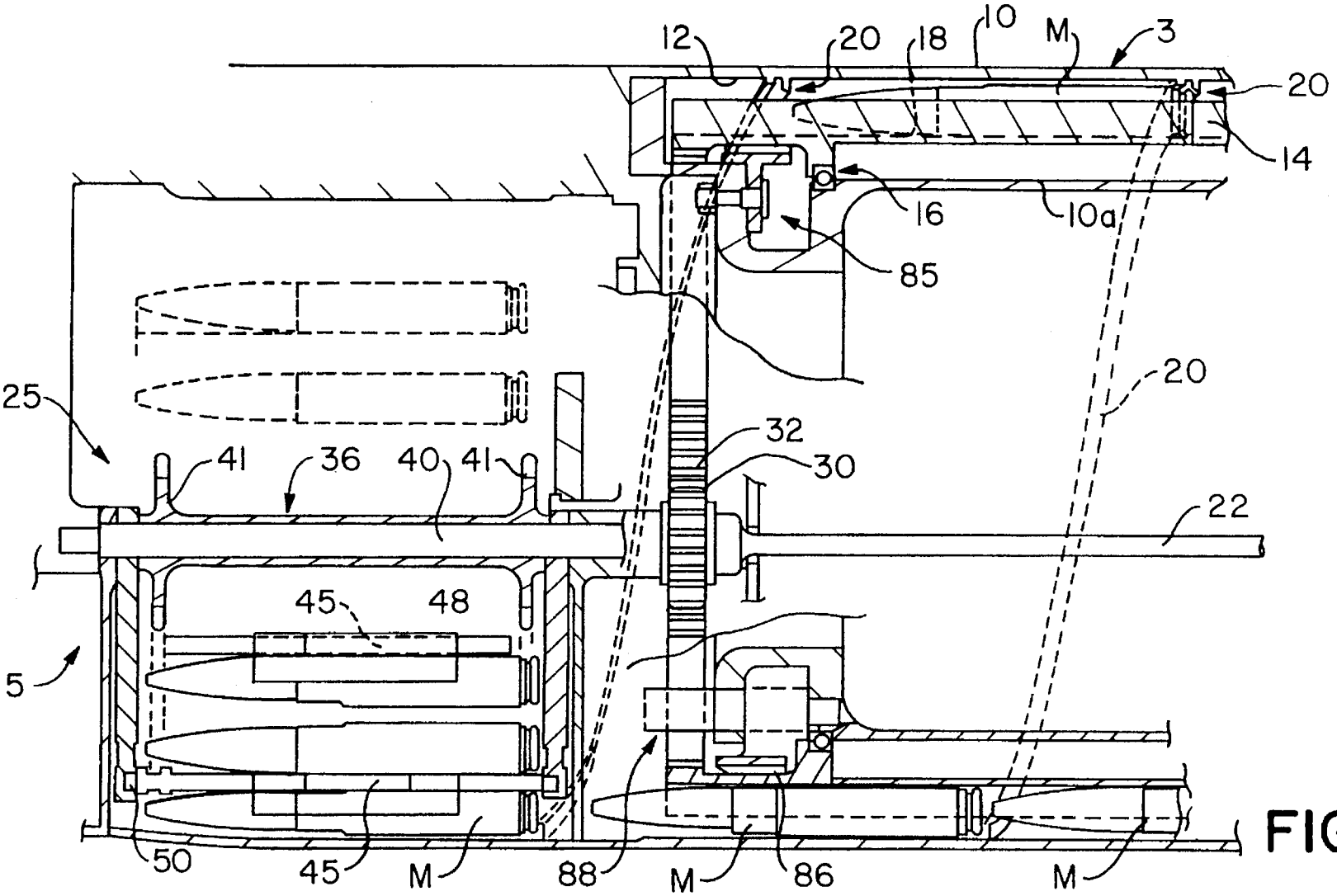
FIG. 4 is a sectional view along the line IV—IV of FIG. 1
Figure 5:
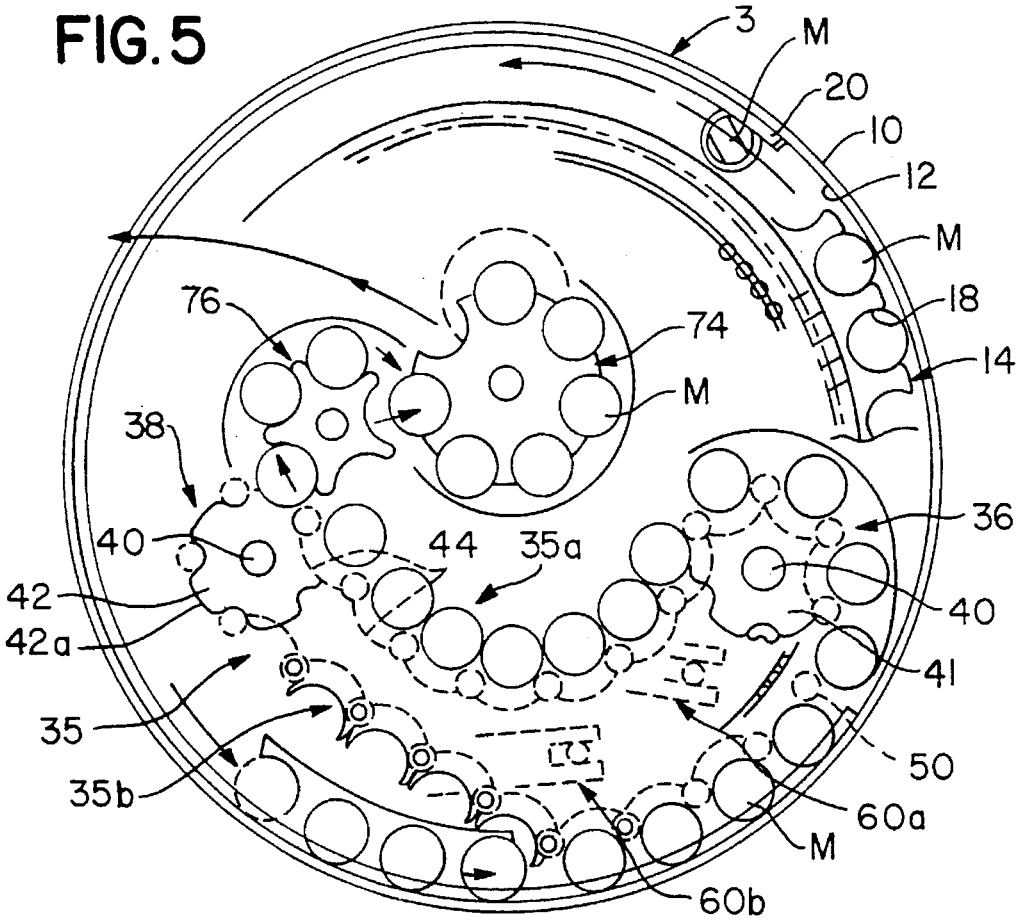
FIG. 5 is a view along the arrow V of FIG. 1.

The conveyer 25, as illustrated in FIGS. 4 to 9, is of the endless chain type 35 and forms an elastic link between the ammunition box 3 and the weapon loading and firing system 7. The chain 35 is situated in a plane perpendicular to the axis X—X, and is wound over two drive wheels 36 and 38 which each consist of a shaft 40 and of two pinions 41 (wheel 36) and 42 (wheel 38) integral with the shaft 40. The drive wheel 36 is situated on the ammunition box 3 side and its shaft 40 is in fact an extension of the control shaft 22, so that the wheel 36 is controlled in synchronism with the ammunition support unit 14 (FIG. 4). The drive wheel 38 is situated on the weapon loading and firing system 7 side and its shaft 40 is driven by said system as explained later.

The chain 35 (FIG. 6) consists of a succession of elastically deformable links 44 linked in pairs in an articulated way by spacer spindles 45. A cradle 48 slides and is articulated on two consecutive spacer spindles 45, respectively. Each cradle 48 includes two elastic edges 48*a* for accommodating and supporting an ammunition round M. Each spacer spindle 45 supports a roller 50 in rotation at each of its ends.

Figure 8:
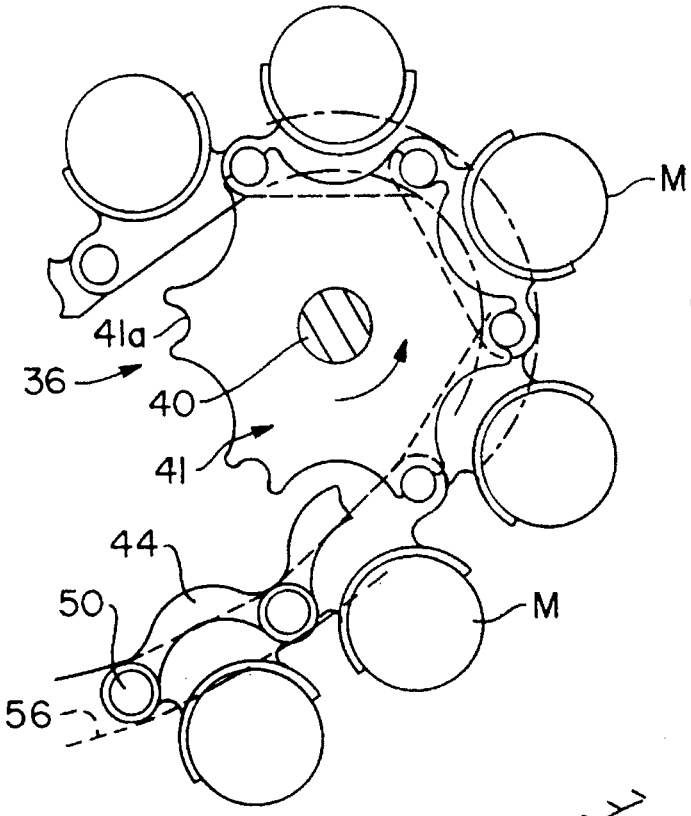
FIG. 8 is a partial sectional view of the drive wheel of the conveyor, on the ammunition box side.

Referring to FIG. 8, each tooth of the pinions 41 of the drive wheel 36 includes a notch 41*a* at its end. Each notch 41 is intended to accommodate a spacer spindle 45 in order to provide the drive for the chain 35 during rotation of the pinions 41.

Figure 9:
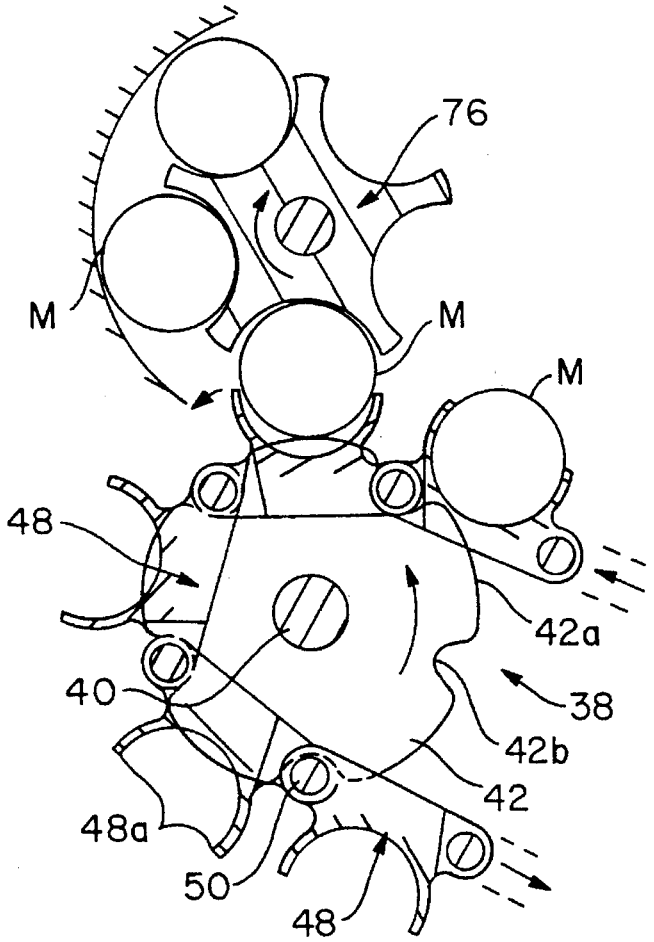
FIG. 9 is a partial end view of the drive wheel of the conveyor, on the weapon side.

Referring to FIG. 9, each tooth of the pinions 42 of the drive wheel consists of a lobe 42*a*, the function of which will be explained later, two consecutive lobes 42*a* delimiting a groove 42*b* intended to accommodate a spacer spindle 45 in order to provide the drive for the chain 35 during rotation of the pinions 42.

Figure 7:
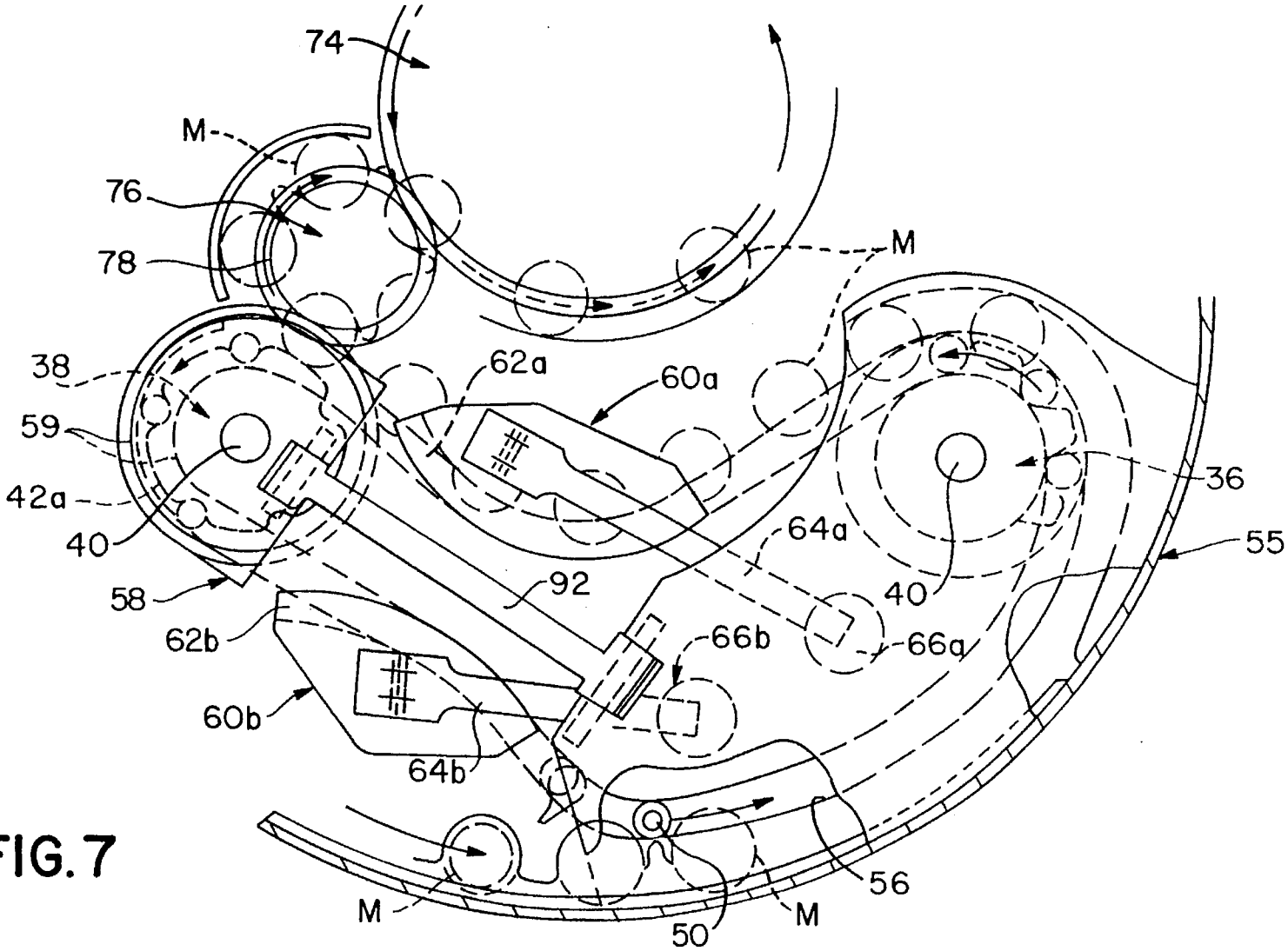
FIG. 7 is a sectional view along the line VII—VII of FIG. 1.

Referring to FIG. 7, a first generally C-shaped casing 55 partially surrounds the drive wheel 36 situated on the ammunition box 3 side, supports the shaft 40 of this wheel 36 and includes two lateral slots 56 which serves as guideways for the rollers 50. In a similar way, a second generally C-shaped casing 58 partially surrounds the second drive wheel 38, supports the shaft 40 of this wheel 38 and also includes two lateral slots 59 which serve as guideways for the rollers 50. These two casings 55 and 58 act together to hold the chain 35 on the two drive wheels 36 and 38. The casing 55 which supports the drive wheel 36 of the conveyor 25, on the ammunition box 3 side, is integral, for example, with the fixed body 10 of said box 3, whereas the casing 58 which supports the drive wheel 38, on the weapon side, is integral with the weapon.

Figure 6:
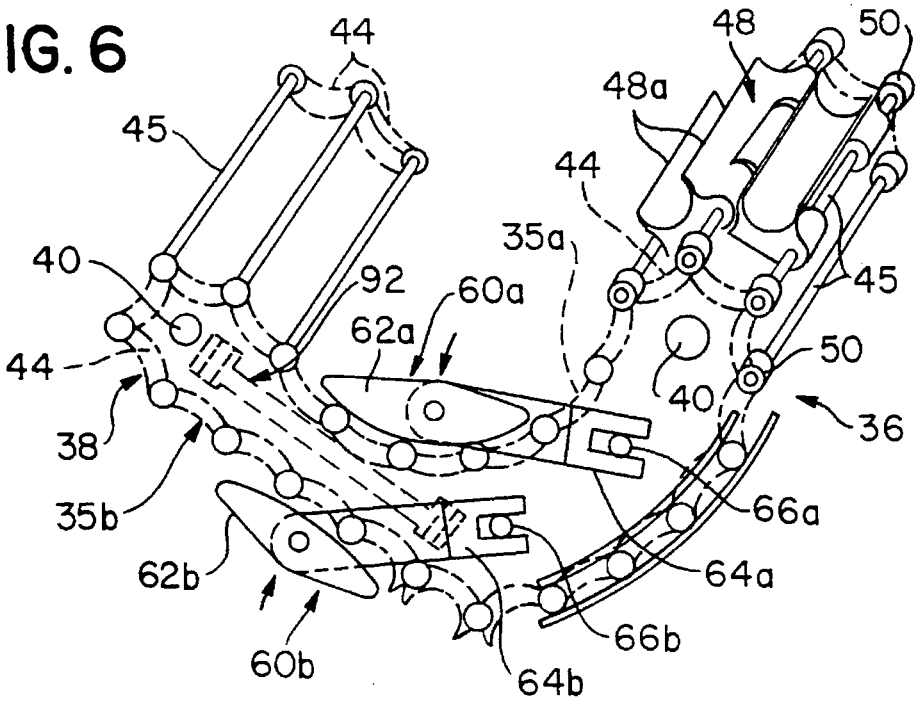
FIG. 6 is a simplified view of a chain conveyor of the feed system.

In order not to disturb the operation of the drive mechanism 5 during the recoil movement of the weapon consequent on the firing of ammunition M, the two casings 55 and 58 are advantageously linked to one another by a deformable parallelogram 92 (FIGS. 6 and 7).

The chain 35 is divided overall into an outward upper strand 35*a* the cradles 48 of which support ammunition M, and a return lower strand 35*b* the cradles 48 of which are empty of ammunition M.

The chain 35 (FIGS. 6, 7 and 10) interacts with at least two upper 60*a* and lower 60*b* pivoting tension members associated respectively with the two upper 35*a* and lower 35*b* strands of the chain 35. These two tension members 60*a* and 60*b* pivot in a plane perpendicular to the axis X—X. Each tension member 60*a*, 60*b* consists of a shoe 62*a*, 62*b* bearing on the associated strand of chain 35*a*, 35*b* and is articulated at the end of an arm 64*a*, 64*b* the other end of which is linked to the end of a torsion-controlled bar 66*a*, 66*b*. Each bar 66*a*, 66*b* is immobilized, near its other end, by a locking means consisting of two concentric inner and outer toothed features 68 mashed in one another. The outer toothed feature is carried by the bar 66*a*, 66*b* and the inner toothed feature is that of a support 69 traversed by the bar. Thus, when a torsion force is applied to the bar 66*a*, 66*b* as a result of a pivoting movement of the arm 64*a*, 64*b*, the corresponding tension member 60*a*, 60*b* is put under tension and is released or freed as soon as the torsion force is no longer applied to the bar 66*a*, 66*b*. The tension members 60*a* and 60*b* are directly controlled in terms of tension by deformations of the chain 35, but they do not act simultaneously in the same direction, that is to say that when one member 60*a* or 60*b* is put under tension, the other member 60*b* or 60*a* is freed and vice-versa.

Figure 10:
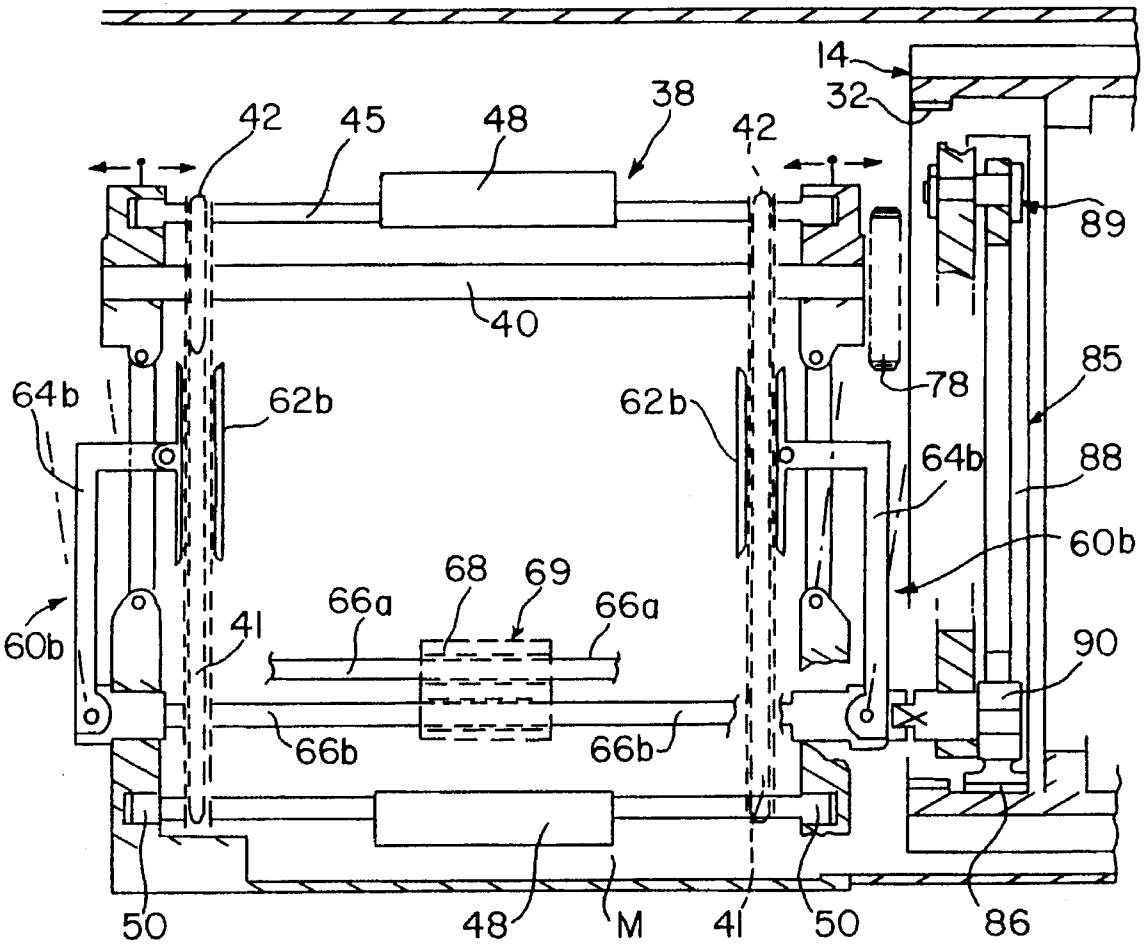
FIG. 10 is a view along the arrow X of FIG. 1.

The weapon loading and firing system 7 may be a barrel-type system for example. The chambers of the barrel (not represented) are loaded with ammunition M from an insertion star wheel 74 situated in the extension of the barrel and linked in rotation with the latter, and of a feed star wheel 76 which carries out the transfer of the ammunition M between the conveyor 25 and the insertion star wheel 74. Pinions 78 provide the transmission of the rotational movement from the insertion star wheel 74 to the feed star wheel 76 on the one hand, and to the drive wheel 38 of the chain 35 on the other hand (FIGS. 7 and 10). The rotational movement of the drive wheel 38 of the conveyor 25 is thus imparted by the weapon and it may result from the intermittent rotational movement of the barrel caused by borrowing propulsion gases from fired ammunition, for example.

The feed system 1 also comprises an auxiliary energy source in order to obtain an instantaneous rise in rate of the weapon at the start of a burst. This auxiliary energy source consists, for example, of an elastically deformable means capable of storing energy and of yielding it up instantaneously at the start of the firing of a burst in order to control the drive mechanism 5. In the example illustrated, this auxiliary energy source is a torsion bar which is advantageously constituted by the control shaft 22 of the drive mechanism 5.

To this end, the motor/reducing gear M1 which driven the shaft 22 is associated with a free wheel 80 which keeps the shaft at the desired torsion force before the firing of the burst in cooperation with a braking device 85 which acts on the ammunition rotary support unit 14 driven by the shaft 22.

Figure 11:
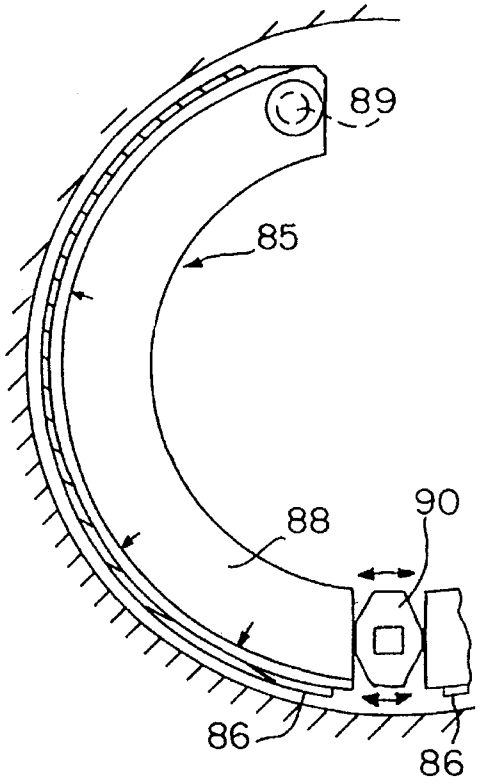
FIG. 11 is a partial view of a braking device of the feed system.

Referring to FIGS. 4, 10 and 11, the braking device 85 is accommodated within the ammunition support unit 14 and mounted on a fixed support 10*a* integral with the body 10 of the ammunition box 3. The braking device 85 includes two curved shoes 86 supported by two pivoting jaws 88. Each shoe 86 extends substantially over half of the circumference of the cylindrical inner wall of the support unit 14. One end of each jaw 88 is mounted so as to pivot about a shaft 89 supported by the fixed support 10*a*, while its other end is supported on a cam 90 common to the two jaws 88 in order to control them simultaneously. The cam 90 is integral with the control bar 66*b* of the lower tension member 60*b*, the torsional movement of the bar 66*b* entailing a rotational movement of the cam 90 in order to space apart or bring together the jaws 88 of the inner wall of the support unit 14.

When the weapon is ready to fire a burst, the ammunition support unit 14 is immobilized in rotation by the braking device 85, and the control shaft 22 is under tension at a torsion force determined by the motor member M1 associated with the free wheel 80.

It results therefrom that:

the drive wheel 36 of the conveyor 25 is immobilized but is nevertheless subjected to a rotational drive force exerted by the control shaft 22, which has the effect of slackening the upper strand 35*a* of the chain 35 and, by opposition, stretching the lower strand 35*b* of the chain 35, the upper tension member 60*a* is bearing via its shoe 62*a* on the upper strand 35*a* of the chain 35, which has the effect of placing the strand 35*a* under tension, curving it inwards, the upper tension member 60*a* not being under tension, that is to say that its control bar 66*a* is not subjected to a torsion force, as a consequence of the tension of the lower strand 35*b* of the chain 35, the lower tension member 60*b* is under tension, that is to say that its control bar 66*b* is subjected to a torsion force, and the shoes 86 of the braking device 85 are bearing against the inner surface of the ammunition M support unit 14 in order to immobilize the letter in rotation.

It is also assumed that the weapon is loaded, that is to say that an ammunition round M is fully loaded in one chamber of the barrel which is axially aligned with the tube of the weapon.

As soon as the abovementioned ammunition round M or first ammunition round of the burst is fired, the barrel 70 performs a rotation by 1/nth of a revolution (n being the number of chambers of the barrel), causing the rotation of the insertion star wheel 74, of the feed star wheel 76 and of the drive wheel 38 of the conveyor 25 by the pinions 78.

It results therefrom that:

the upper strand 35*a* of the chain 35 stretches and pushes back the upper tension member 60*a* which is put under tension as a result of the torsion force imposed on its control bar 66*a*, the amplitude of pivoting of the upper tension member 60*a* being sufficient for its arm 64*a* to come into contact with a switch (not represented) for control of the motor M1, the lower strand 35*b* of the chain is relaxed, but it is instantaneously again put under tension by the lower tension member 60*b* which pivots inward as a result of the liberation of the energy stored by the torsion of its control bar 66*b*, the braking device 85 is freed as a result of the rotation of the control cam 90 integral with the pivoting movement of the arm 64*b* of the lower tension member 60*b*, the rotation of the cam 90 having spaced the shoes 86 of the braking device 85 away from the inner surface of the ammunition support unit 14, and the control shaft 22 instantaneously releases its energy as a result of the unlocking in rotation of the ammunition support unit 14.

In practical terms, the energy released instantaneously by the torsion shaft 22 allows instantaneous rotational control of the ammunition M support unit 14 and of the drive wheel 36 of the conveyor 25, which makes it possible to obtain a rapid rise in rate which could not be obtained solely by the drive motor M1 of the torsion shaft 22. In contrast, the motor M1 then maintains the rotation of the shaft 22 which again becomes a conventional control shaft throughout the duration of the firing of the burst.

As soon as the drive wheel 36 of the conveyor 25 is driven in rotation, the upper strand 35*a* of the chain 35 is relaxed, the lower strand 35*b* is stretched, the upper tension member 60*a* is relaxed and the lower tension member 60*b* is put under tension. However, the lower tension member 60*b* does not have the time to stretch completely, since as soon as a new round is fired, the barrel of the weapon and consequently the drive wheel 36 of the conveyor 25 again performs a rotation by one nth of a revolution, which has the affect of stretching the upper strand 35*a* of the chain 35 and of relaxing the lower strand 35*b*, and so on at each intermittent rotation of the barrel. The upper 60*a* and lower 60*b* tension members are therefore subjected to alternating pivoting movements.

Within the box 3, the ammunition M is simultaneously driven in rotation around the axis X—X by the support unit 14 and in translation within each chute 18 as a result of their bearing against the fixed helical ramp 20. The ammunition rounds M, at the outlet from the box 3, are picked up, one by one, by the chain 35 of the conveyor 25. More precisely, the support unit 14 and the drive wheel 36 of the conveyor 25 turn in synchronism with the chutes 18 of the support unit 14 which are opposite the cradles 48 of the chain 35, so that each ammunition round M is progressively pushed by the helical ramp 20 toward the cradles 48 of the chain 35. The ramp 20 has a variable pitch in order to increase the amplitude of movement of the ammunition rounds M when the letter are engaged in the cradles 48 of the chain 35. The ammunition M is then led by the upper strand 35*a* of the chain 35 to the feed star 76 and picked up by the latter to be transferred on to the insertion star wheel 74, then progressively loaded into the chambers of the barrel.

It is important to note that the lobes 42*a* of the pinions 42 of the drive wheel 38 of the conveyor 25 bear on the ammunition M in order to free it from the cradles 48 and to facilitate it being picked up by the feed star wheel 76.

The jerks due to the intermittent rotational movement of the barrel are taken up by the chain 35, the oscillations of which are damped by the tension members 60*a* and 60*b*.

During the firing of the burst, the oscillations of the strands 35*a* and 35*b* of the chain 35 are damped by the tension devices 60*a* and 60*b*, but the amplitude of pivoting of these devices remains limited, so that the lower tension device 60*b* is not in a position to be able to control the braking device in a way which is sufficient to cause immobilization in rotation of the ammunition M support unit 14. It is only at the start and the end of the burst that the amplitude of pivoting of the lower tension device 60*b* is sufficient to immobilize the ammunition M support unit 14.

At the last round of the burst, the barrel of the weapon is instantaneously immobilized, but the ammunition box 3 continues to turn, which, by means of the drive wheel 36 of the conveyor 25, causes a relaxing of the upper strand 35*a* of the chain 35 which is compensated for by the upper tension member 60*a* which relaxes, and a tensioning of the lower strand 35*b* of the chain 35 which pushes back the lower tension member 60*b* with its control bar 66*b* being put under torsion. The amplitude of the pivoting of the lower tension member 60*b* is then sufficient to cause actuation of the braking device 85 the shoe 86 of which comes in contact with the inner surface of the support unit 14 so as to immobilize the latter in rotation. The motor M1 is then stopped automatically as soon as the control shaft 22 is again loaded to a torsion force determined for firing a new burst.

During the recoil movement of the weapon, consequent on the firing of ammunition M, the ammunition box 3 remains fixed, but the deformable parallelogram 92 allows the part of the conveyor 25, on the weapon side, to move laterally in order to follow the recoil movement of the weapon, the structure of the chain 35 being designed to allow such a movement.

Advantageously, the fixed body 10 of the ammunition box 3 may be integrated into a container which also supports the weapon, such a container of compact form being particularly suitable for being installed on an aircraft.

Finally, the feed system according to the invention may be used for different types of weapons with higher or lower firing rates.

I claim:

1. An ammunition feed system for a medium-calibre firearm, comprising: a box in which ammunition is stored; a drive mechanism for extracting said ammunition from said box; said drive mechanism leading said ammunition to a weapon loading and firing system of said firearm; said drive mechanism including a plurality of links interposed between said ammunition box and said weapon loading and firing system; said links forming a chain conveyor having an outward upper strand and a return lower strand; said chain conveyor further including an oscillation damping mechanism having upper and lower tension members respectively associated with said upper and lower strands.

2. The feed system according to claim 1, wherein said drive mechanism further includes a motor and at least two drive wheels respectively situated on the ammunition box side and the weapon side and around which said conveyor extends, said wheels being rotated respectively by said drive mechanism motor and by a motor of the firearm.

3. The feed system according to claim 2, wherein the chain conveyor includes a plurality of pairs of links, each pair connected at opposite ends thereof by spacer spindles, and cradles supported by said spacer spindles.

4. The feed system according to claim 3, wherein each cradle is mounted on two consecutive spacer spindles.

5. The feed system according to claim 4, wherein each cradle includes elastic lateral edges extending between an associated pair of links and between which edges an ammunition round is retained on the cradle.

6. The feed system according to claim 3, wherein said drive wheels each include a shaft and two pinions integral with said shaft for engaging with said chain conveyor.

7. The feed system according to claim 6, wherein each tooth of said pinions, on the ammunition box side, includes a notch accommodating one of said spacer spindles so as to provide drive for the chain conveyor.

8. The feed system according to claim 6, wherein each tooth of said pinions, on the firearm side, is formed by a lobe, wherein two consecutive lobes delimit a groove, said groove accommodating a said spacer spindle, said spacer spindle providing the drive for said chain, each of said lobes being capable of disengaging a round of ammunition from said cradle when said round of ammunition arrives near the drive wheel of said chain conveyor.

9. The feed system according to claim 6, further comprising first and second casings respectively surrounding each drive wheel; each said casing including guide slots; said spacer spindles having rollers at opposite ends thereof; said rollers being received in said guide slots.

10. The feed system according to claim 9, wherein the first casing, on the ammunition box side, is integral with the body of the ammunition box, and wherein said second casing, on the weapon side, is integral with the weapon, and further including plural links connected to form a deformable parallelogram to link said first and second casings together without disturbing said drive mechanism during the recoil movement of the weapon consequent on the firing of a round of ammunition.

11. The feed system according to claim 2, wherein said weapon firing and loading system further comprises a feed star wheel which interacts with said drive wheel of the conveyor, on the weapon side; and an insertion star wheel which interacts with said feed star wheel in order progressively to load the ammunition into the weapon loading and firing system of said firearm, said drive wheel and said feed and insertion star wheels being driven by rotation of the weapon loading and firing system of said firearm.

12. The feed system according to claim 1, wherein the ammunition box further comprises a fixed hollow body; said hollow body delimiting a cylindrically shaped internal housing; said internal housing having an inside surface and an outside surface; and a hollow cylindrical support unit; said support unit mounted so as to rotate within the housing, said support unit including, at a periphery thereof, a plurality of ammunition-accommodating chutes, said chutes being generally parallel to the longitudinal axis of said housing and regularly distributed around said support unit; each chute being generally semicircular in nature so as to accommodate a round of ammunition.

13. The feed system according to claim 12, wherein an inside circumference of said chutes and the inside surface of the inner housing of the ammunition box body are separated by a distance slightly greater than the diameter of a round of ammunition.

14. The feed system according to claim 13, wherein the drive mechanism further comprises a fixed, variable-pitch, helical ramp provided on said inside surface of the inner housing of the ammunition box body; a first shaft for rotational control of the ammunition support unit; and a main energy source for driving the shaft in rotation.

15. The feed system according to claim 14, wherein said first shaft is housed within the ammunition support unit, and further including a pinion integral with the shaft and engaging a toothed crown wheel provided on the inside surface of the ammunition support unit.

16. The feed system according to claim 15, further comprising a second shaft associated with the drive wheel of said chain conveyor on the ammunition box side; said second shaft being integral with the first shaft.

17. The feed system according to claim 15, further comprising an auxiliary energy source for controlling the rotation of said first and second shafts and said drive wheel of said chain conveyor on the ammunition box side.

18. The feed system according to claim 17, wherein the auxiliary energy source includes an elastically deformable means for storing energy and yielding said energy instantaneously upon firing a round of ammunition.

19. The feed system according to claim 18, wherein said first shaft for rotational control of the ammunition support unit, on the ammunition box side, is a torsion shaft which also constitutes said auxiliary energy source.

20. The feed system according to claim 19, wherein said torsion shaft is loaded to a torque value determined by said motor which is associated with a free wheel in order to keep said torsion shaft in a loaded state, and wherein said feed system further comprises a braking device for immobilizing the ammunition support unit.

21. The feed system according to claim 1, wherein said upper and lower tension members each include an arm pivoting in a plane parallel to that of said chain, a shoe pivotally mounted to one end of each pivoting arm to bear on the associated strand of chain, and a torsion bar fixed to the other end of each arm to stress said shoe bearing on the associated strand of chain.

22. The feed system according to claim 21, said ammunition box further comprising a fixed hollow body; said hollow body delimiting a cylindrically shaped internal housing; said internal housing having an inside surface and an outside surface; and a hollow cylindrical support unit mounted to rotate within the housing; wherein said tension member controls a braking device for immobilizing the support unit.

23. The feed system according to claim 22, said braking device further comprising two curved shoes supported by pivoting jaws and intended to come in contact with said support unit, each jaw being mounted so as to pivot, at one end, around a fixed shaft, whereas its other end is supported on a cam common to both jaws.

24. The feed system according to claim 23, wherein the cam is integral with the torsion bar of the lower tension member, the torsional movement of said bar causing rotational movement of said cam.

25. The feed system according to claim 1, wherein the ammunition box is integrated into a container which also supports the weapon.

* * * * *